US007866780B2

(12) United States Patent
Rai

(10) Patent No.: US 7,866,780 B2
(45) Date of Patent: Jan. 11, 2011

(54) LIQUID DROPLET EJECTING APPARATUS

(75) Inventor: Yoshihira Rai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 275 days.

(21) Appl. No.: 12/127,058

(22) Filed: May 27, 2008

(65) Prior Publication Data

US 2009/0160905 A1 Jun. 25, 2009

(30) Foreign Application Priority Data

Dec. 20, 2007 (JP) ..... 2007-328448

(51) Int. Cl.
*B41J 2/205* (2006.01)

(52) U.S. Cl. ..... 347/15; 347/43

(58) Field of Classification Search ..... 347/12, 347/13, 42, 40, 43, 15, 14, 16
See application file for complete search history.

(56) References Cited

U.S. PATENT DOCUMENTS

2005/0275684 A1 12/2005 Yamaguchi et al.

FOREIGN PATENT DOCUMENTS

| | | |
|---|---|---|
| JP | 2001-018387 | 1/2001 |
| JP | 2002-225261 | 8/2002 |
| JP | 2003-127385 | 5/2003 |
| JP | 2005-349660 | 12/2005 |

*Primary Examiner*—Lamson D Nguyen
(74) *Attorney, Agent, or Firm*—Fildes & Outland, P.C.

(57) ABSTRACT

A liquid droplet ejecting apparatus, comprising: a plurality of liquid droplet ejecting heads arranged in parallel to each other, and the liquid droplet ejecting heads having the same liquid droplet ejectable width, and at least one of the liquid droplet ejecting heads being shifted in a widthwise direction of the liquid droplet ejectable width with respect to other liquid droplet ejecting heads, the liquid droplet ejecting apparatus having the following relationship: an image quality assured width<the liquid droplet ejectable width<a liquid droplet ejectable width of the apparatus using all of the plurality of liquid droplet ejecting heads, is provided.

5 Claims, 9 Drawing Sheets

LIQUID DROPLET EJECTING APPARATUS

CROSS-REFERENCE TO RELATED APPLICATIONS

This application is based on and claims priority under 35 USC 119 from Japanese Patent Application No. 2007-328448 filed on Dec. 20, 2007.

BACKGROUND

1. Technical Field

The present invention relates to a liquid droplet ejecting apparatus.

2. Related Art

As a liquid droplet ejecting apparatus, an ink jet recording apparatus is known.

SUMMARY

According to an aspect of the invention, there is provided a liquid droplet ejecting apparatus having: a plurality of liquid droplet ejecting heads arranged in parallel to each other, wherein the liquid droplet ejecting heads have the same liquid droplet ejecting-possible widths, and at least one of the liquid droplet ejecting heads is deviated in a widthwise direction of the liquid droplet ejecting-possible width with respect to other liquid droplet ejecting heads, the liquid droplet ejecting apparatus has the following relation: an image quality ensuring width<the liquid droplet ejecting-possible width<a liquid droplet ejecting-possible width of the apparatus by all of the plurality of liquid droplet ejecting heads.

DETAILED DESCRIPTION

One example of an exemplary embodiment of the present invention will be explained below.

In the exemplary embodiment, an ink jet recording apparatus which ejects ink droplets to record an image on a recording medium will be explained as one example of a liquid droplet ejecting apparatus which ejects liquid droplets.

The liquid droplet ejecting apparatus is not limited to the ink jet recording apparatus. As the liquid droplet ejecting apparatus, for example, it may be a color filter producing apparatus which ejects ink or the like onto a film or glass to produce a color filter, an apparatus which ejects molten solder onto a substrate to form a part-mounting bump, an apparatus which ejects liquid including metal to form a wiring pattern, and various film forming apparatuses which eject liquid droplet to form a film, as long as it is an apparatus which ejects liquid droplets.

(Overall Structure of the Ink Jet Recording Apparatus of the Exemplary Embodiment)

Figure 1:
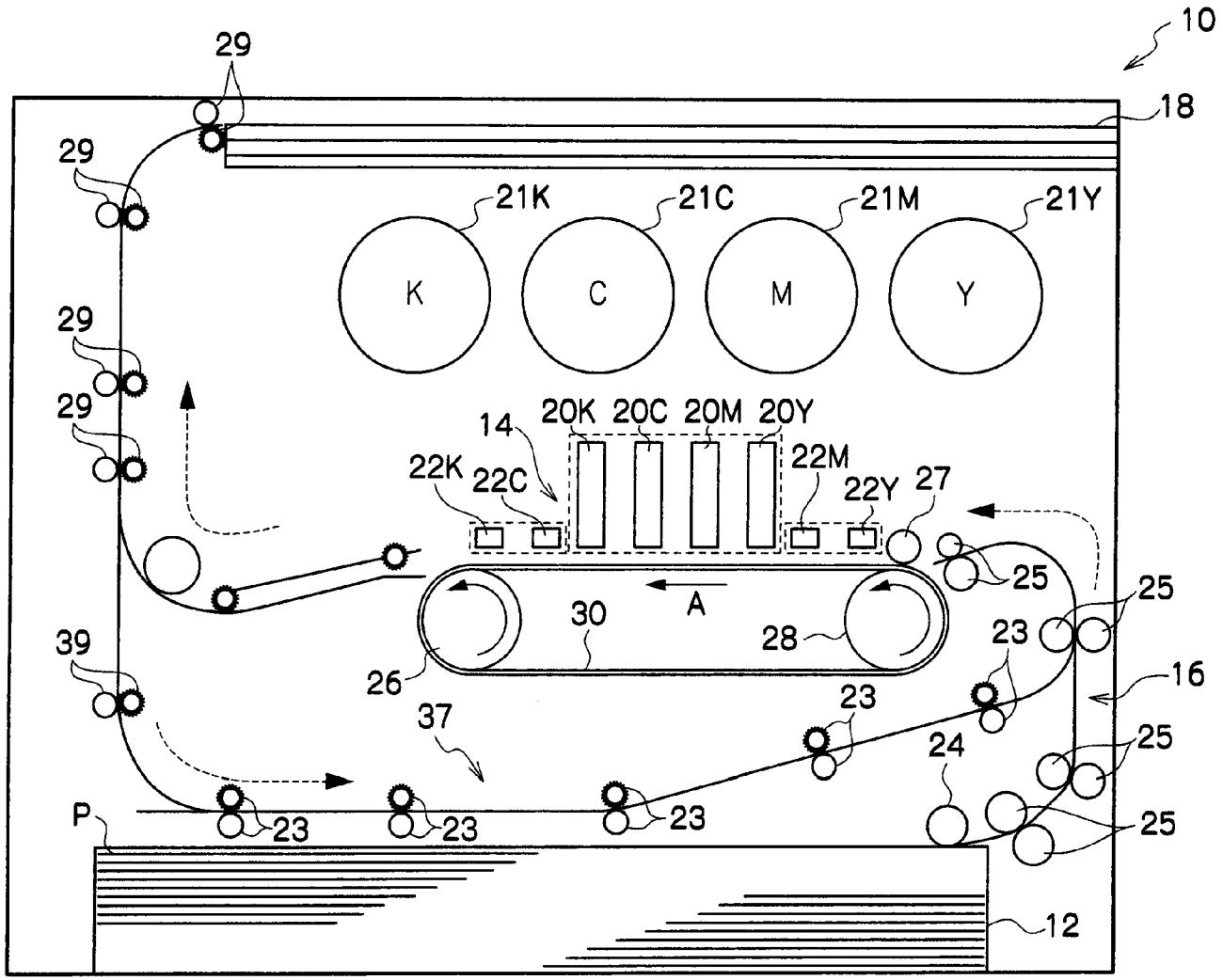
FIG. 1 is a schematic diagram showing the overall structure of an ink jet recording apparatus of an exemplary embodiment.
Figure 2:
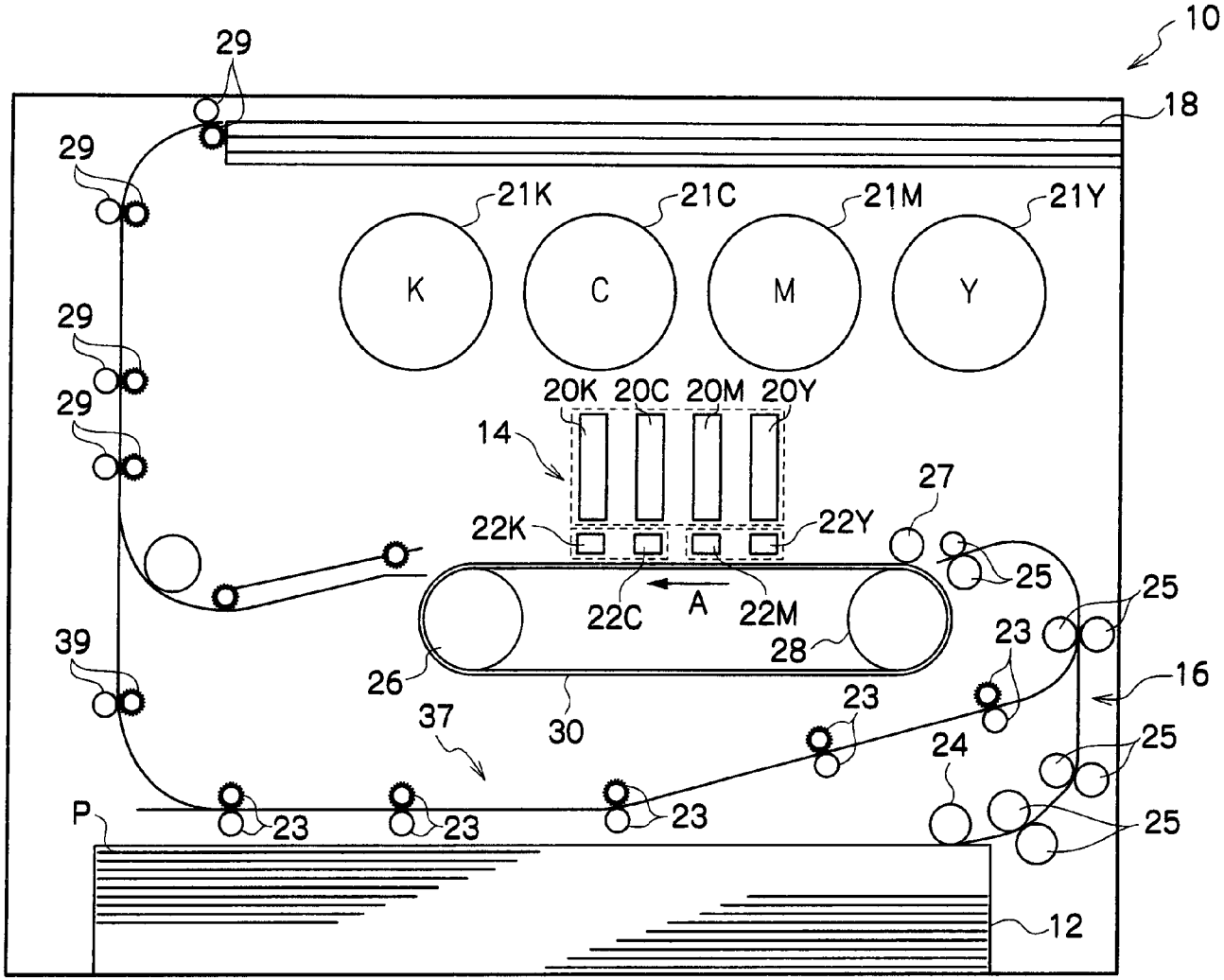
FIG. 2 is a schematic diagram showing a state of the ink jet recording apparatus of the exemplary embodiment in which a maintenance unit is in an opposed position opposed to a nozzle surface of an ink jet recording head.

First, the overall structure of the ink jet recording apparatus of the exemplary embodiment will be explained. FIGS. 1 and 2 are schematic diagrams showing the overall structure of the ink jet recording apparatus of the exemplary embodiment.

As shown in FIGS. 1 and 2, the ink jet recording apparatus 10 includes a recording medium accommodating portion 12 in which recording media P such as paper sheets are accommodated, an image recording portion 14 for recording an image on the recording medium P, a transfer portion 16 which transfers the recording media P from the recording medium accommodating portion 12 to the image recording portion 14, and a recording medium discharge portion 18 from which a recording medium P on which image is recorded by the image recording portion 14 is discharged.

The image recording portion 14 includes ink jet recording heads 20Y, 20M, 20C and 20K (20Y to 20K, hereinafter) for ejecting ink droplet to record an image on the recording medium as one example of the liquid droplet ejecting head which ejects liquid droplets.

The ink jet recording heads 20Y to 20K are arranged in parallel in the order of yellow (Y), magenta (M), cyan (C) and black (K) from the upstream side in the transfer direction of the recording medium P. Ink droplets corresponding to respective colors are ejected from a plurality of nozzles formed in a nozzle surface by a piezoelectric manner, thereby recording an image. In this manner, the ink jet recording heads 20Y to 20K eject ink of different colors as one example of different liquids.

The ink jet recording heads 20Y to 20K may eject ink of the same color or the same liquid. In the ink jet recording heads 20Y to 20K, the structure for ejecting ink droplet may be a structure that the ink droplet is ejected by another manner such as thermal manner.

The ink jet recording apparatus 10 is provided with ink tanks 21Y, 21M, 21C and 21K (21Y to 21K, hereinafter) in which ink is stored. Ink is supplied from the ink tanks 21Y to 21K to each of the ink jet recording heads 20Y to 20K. Various kinds of ink such as water-based ink, oil-based ink and solvent ink may be used as the ink supplied to the ink jet recording heads 20Y to 20K.

The ink jet recording apparatus 10 is provided with maintenance units 22Y, 22M, 22C and 22K (22Y to 22K, hereinafter) for performing maintenance of the ink jet recording heads 20Y to 20K. The maintenance units 22Y to 22K may move between an opposed position (see FIG. 2) opposed to the nozzle surfaces of the ink jet recording heads 20Y to 20K, and a retract position (see FIG. 1) where the maintenance units are retracted from the nozzle surfaces of the ink jet recording heads 20Y to 20K.

The maintenance units 22Y to 22K include caps for covering the nozzle surfaces of the ink jet recording heads 20Y to 20K, receiving members for receiving liquid droplets which are preliminarily ejected (idle ejection), cleaning members for cleaning the nozzle surfaces of the ink jet recording heads 20Y to 20K and suction devices for suctioning ink in the nozzles. When maintenance of the ink jet recording heads 20Y to 20K is performed, the ink jet recording heads 20Y to 20K rise to a predetermined height, the maintenance units 22Y to 22K move to the opposed position and various maintenance operations are carried out.

The transfer portion 16 includes a delivering roll 24 for delivering the recording medium P accommodated in the recording medium accommodating portion 12, pairs of transfer rolls 25 for sandwiching and transferring the recording medium P which has been delivered by the delivering roll 24, and an endless transfer belt 30 for bringing a surface to be recorded of the recording medium P transferred by the pairs of transfer rolls 25 to be opposed to the ink jet recording heads 20Y to 20K.

The transfer belt 30 is wound around a driving roll 26 disposed at the downstream side of the recording medium P in the transfer direction and a driven roll 28 disposed at the upstream side of the recording medium P in the transfer direction. The transfer belt 30 is cyclically moved in a predetermined direction (direction A in FIG. 1).

The driven roll 28 is provided at its upper portion with a press roll 27 which presses the recording medium P against the transfer belt 30. The press roll 27 follows the transfer belt 30 and functions as a charging roll. The transfer belt 30 is electrically charged by the press roll 27, whereby the recording medium P is electrostatically absorbed by the transfer belt 30 and transferred.

The transfer belt 30 transfers the recording medium P, whereby the ink jet recording heads 20Y to 20K and the recording medium P relatively move, ink droplet is ejected to the relatively moving recording medium P and an image is formed.

The ink jet recording heads 20Y to 20K may move with respect to the recording medium P, and the invention is not limited to this as long as the recording medium P and the ink jet recording heads 20Y to 20K relatively move.

The transfer belt 30 is not limited to one that electrostatically absorbs and holds the recording medium P, and can be structured to hold the recording medium P by the friction therebetween or by other non-electrostatic methods such as suctioning or adhering the recording medium P.

A peeling pawl which peels off the recording medium P from the transfer belt 30 is disposed at the downstream side of the transfer belt 30 such that the peeling pawl may approach to and separate from the transfer belt 30. The recording medium P on which an image is recorded by the ink jet recording heads 20Y to 20K is peeled off from the transfer belt 30 by the curvature of the transfer belt 30 and the peeling pawl. The peeling pawl is omitted in FIGS. 1 and 2.

A plurality of pairs of transfer rolls 29 are provided at the downstream side of the peeling pawl. The transfer rolls 29 at the surface to be recorded side of the recording medium P are star wheels. The recording medium P on which an image is recorded by the image recording portion 14 is transferred to the recording medium discharge portion 18 by the pairs of transfer rolls 29.

An inverting portion 37 for inverting the recording medium P is provided below the transfer belt 30. After the pairs of transfer rolls 29 once transfer the recording medium P to the downstream, the pairs of transfer rolls 29 are reversed, and the recording medium P is sent to the inverting portion 37.

The inverting portion 37 is provided with a plurality of pairs of transfer rolls 23. The transfer rolls 23 at the surface to be recorded side of the recording medium P are star wheels. The recording medium P which has been sent to the inverting portion 37 is then reconveyed to the transfer belt 30.

Although it is not illustrated in the drawings, the ink jet recording apparatus 10 includes a head controller for determining ejection timing of ink droplet in accordance with image data and nozzles to be used of the ink jet recording heads 20Y to 20K, and a system control portion for controlling the operations of the overall ink jet recording apparatus 10.

Next, an image recording operation of the ink jet recording apparatus 10 will be explained.

First, A recording medium P is delivered from the recording medium accommodating portion 12 by the delivering roll 24, and the recording medium P is sent to the transfer belt 30 by the pairs of transfer rolls 25 located at the upstream side with respect to the transfer belt 30.

The recording medium P sent to the transfer belt 30 is absorbed and held on a transfer surface of the transfer belt 30, and is transferred to a recording position of the ink jet recording heads 20Y to 20K, and then an image is recorded on the surface to be recorded of the recording medium P. After the image recording operation is completed, the recording medium P is peeled off from the transfer belt 30 by the peeling pawl.

When an image is recorded only on one side of the recording medium P, the recording medium P is discharged to the recording medium discharge portion 18 by the pairs of transfer rolls 29 located at the downstream side with respect to the transfer belt 30.

When the image is to be recorded on both sides of the recording medium P, after the image is recorded on one side, the recording medium P is inverted by the inverting portion 37, and the recording medium P is again sent to the transfer belt 30. An image is recorded on the other side of the recording medium P in the same manner as the former image, images are recorded on both sides of the recording medium P and the recording medium P is discharged into the recording medium discharge portion 18.

(Structures of the Ink Jet Recording Heads 20Y to 20K of the Exemplary Embodiment)

Figure 3:
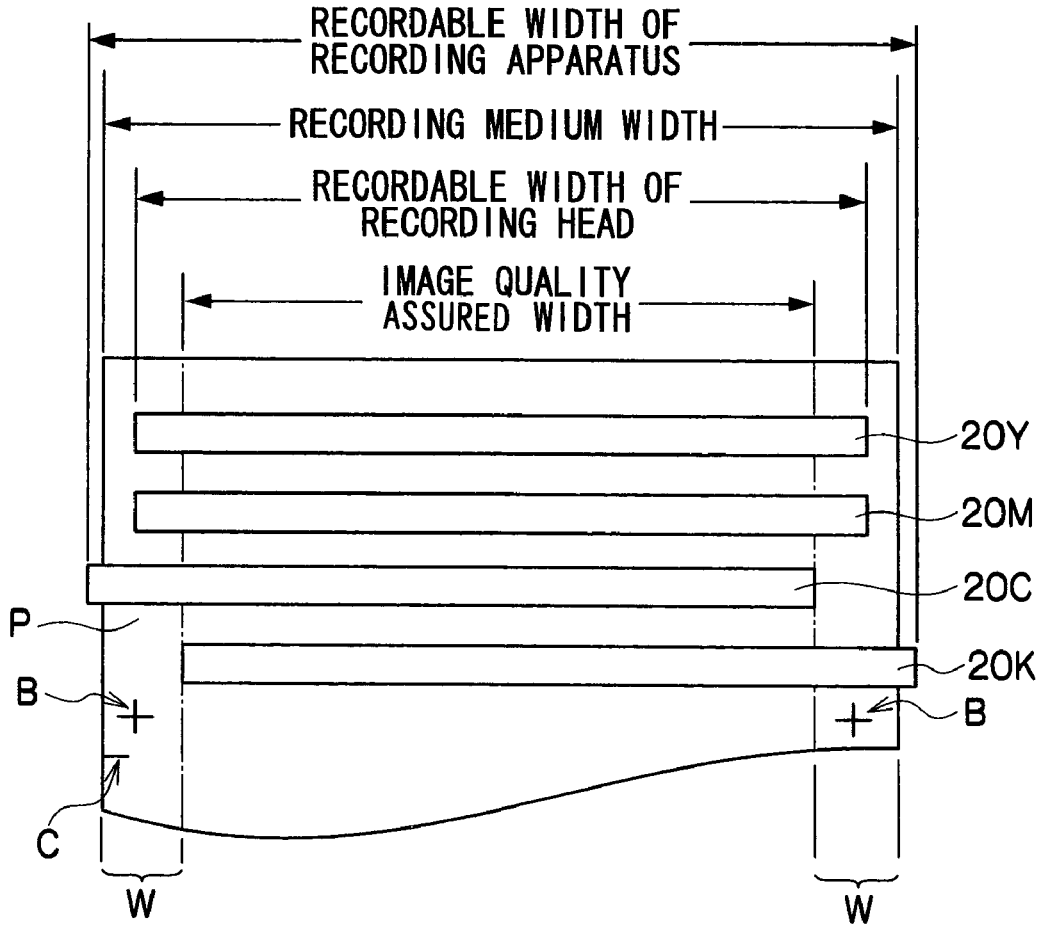
FIG. 3 is a schematic diagram showing the structure of the ink jet recording head of the exemplary embodiment.

As shown in FIG. 3, the ink jet recording heads 20Y to 20K of the exemplary embodiment are longer in the widthwise direction (fast scanning direction) of the recording medium P than in the transfer direction (slow scanning direction) of the recording medium P. The ink jet recording heads 20Y to 20K is structured to be able to form one line in the fast scanning direction without relatively moving the ink jet recording heads in the fast scanning direction with respect to the recording medium P, and the ink jet recording heads 20Y to 20K relatively move in the slow scanning direction with respect to the recording medium P so that a color image may be recorded. The widthwise direction of the recording medium P is a direction intersecting with the transfer direction of the recording medium P.

The ink jet recording heads 20Y to 20K have the same ink droplet ejectable widths through which ink droplet may be ejected, i.e., the same recordable widths through which an image may be recorded. The width mentioned here is a width in the fast scanning direction. The ink jet recording heads 20Y to 20K have the same head lengths in terms of productivity.

The ink jet recording head 20K is shifted toward one end sides of the ink jet recording heads 20Y and 20M in the widthwise direction of the recordable width with respect to the ink jet recording heads 20Y and 20M.

The ink jet recording head 20C is shifted toward the other end sides of the ink jet recording heads 20Y and 20M in the widthwise direction of the recordable width with respect to the ink jet recording heads 20Y and 20M.

A recordable width through which an image may be recorded when all of the four ink jet recording heads 20Y to 20K may be seen, i.e., the recordable width of the ink jet recording apparatus 10 is set greater than the recordable widths of the respective ink jet recording heads 20Y to 20K.

The recordable width of the ink jet recording apparatus 10 is set greater than the recording medium width of the recording medium P on which an image is to be recorded. An image quality assured width of the ink jet recording apparatus 10 is smaller than the recordable widths of the respective ink jet recording heads 20Y to 20K.

As described above, in the ink jet recording apparatus 10, the following relation is established: image quality assured width<recordable widths of the respective ink jet recording heads 20Y to 20K<recording medium width of the recording medium P<recordable width of the ink jet recording apparatus 10.

The image quality assured width of the ink jet recording apparatus 10 is a width of a region where the image quality is assured, and is a width where the image quality assured regions of the respective ink jet recording heads 20Y to 20K overlap each other. The image quality assured region of each of the ink jet recording heads 20Y to 20K is a region where a predetermined resolution is obtained in each of the ink jet recording heads 20Y to 20K.

Figure 4A:
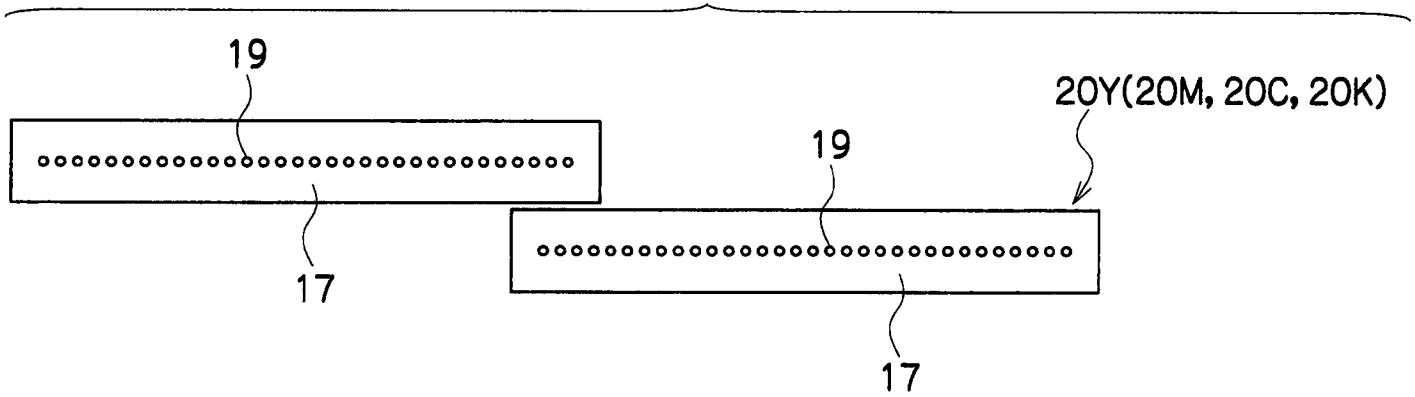
FIG. 4A is a schematic diagram showing an example of nozzle disposition of the ink jet recording head of the exemplary embodiment.

In the case of a structure in which nozzles 19 from which ink droplets are ejected are arranged on one line as shown in FIG. 4A, the resolution in a region where the nozzles 19 from which ink droplets are ejected are disposed do not vary, and the region from one end to the other end of the plurality of nozzles from which ink droplets are ejected is a region wherein a predetermined resolution is obtained.

Figure 4B:
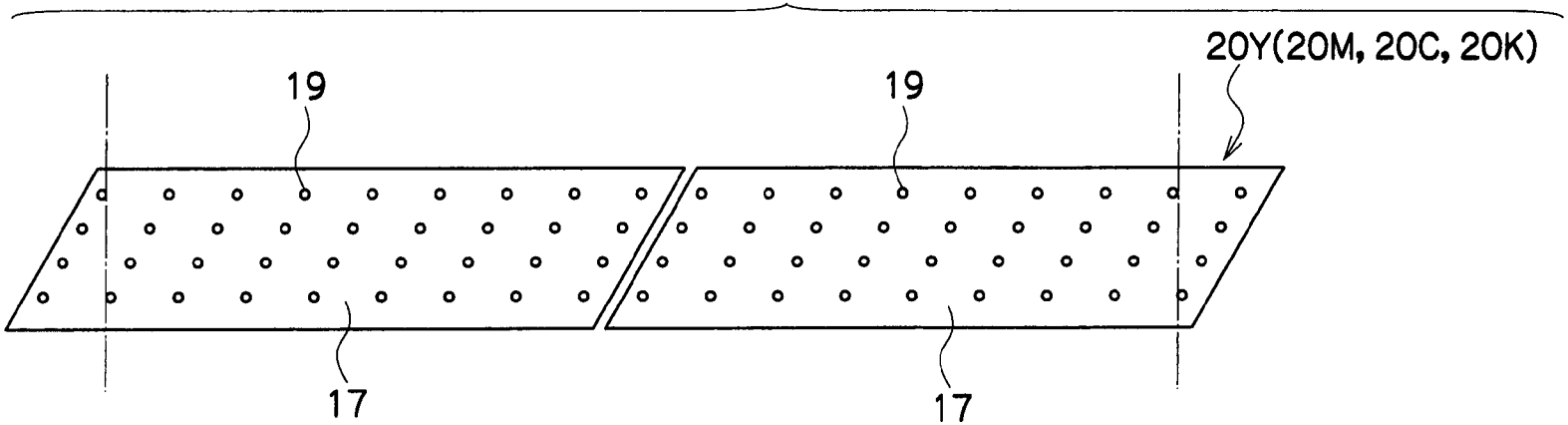
FIG. 4B is a schematic diagram showing an example of nozzle disposition of the ink jet recording head of the exemplary embodiment.

On the other hand, in the case of a structure in which nozzles 19 are disposed two dimensionally as shown in FIG. 4B, the resolution is deteriorated at the end portions of the ink jet recording heads 20Y and 20K (portions outside of the phantom line shown in FIG. 4B) as compared with that at the central portions (portions inside of the phantom line shown in FIG. 4B) in some cases.

The resolution at the end portions of the ink jet recording heads 20Y to 20K is 600 dpi, and the resolution at the central portions of the ink jet recording heads 20Y to 20K is 1200 dpi. In this case, if the predetermined resolution is 1200 dpi, the central portions of the ink jet recording heads 20Y to 20K are the regions where the predetermined resolution may be obtained.

As a structure of the ink jet recording heads 20Y to 20K, the ink jet recording heads 20Y to 20K may construct a plurality of head units 17 as shown in FIGS. 4A and 4B. The structures of the ink jet recording heads 20Y to 20K are schematically shown in FIGS. 4A and 4B for explanation.

(Effect of the Exemplary Embodiment)

Next, the effect of the exemplary embodiment will be explained.

In the ink jet recording apparatus 10 of the exemplary embodiment, in the image quality assured region, a color image is formed on the recording medium P by the ink jet recording heads 20Y to 20K.

Auxiliary drawings such as a dragonfly mark B and a stylus mark C are carried out on one end side of the recording medium P by the ink jet recording head 20K in a region W out of the image quality assured region, and auxiliary drawings such as the dragonfly mark B and the stylus mark C are carried out on the other end side of the recording medium P by the ink jet recording head 20C.

The dragonfly mark B is a mark functioning as a guide of the alignment for post-processes such as color registration, folding or cutting. The dragonfly mark B is an important mark for block copy step, plate making step and image recording step, and is also called a register mark, a registration mark, or a crop mark. The dragonfly mark B is generally cross-shaped, and since this shape is similar to a dragonfly, it is also called a dragonfly mark.

The stylus mark C is a mark for checking whether an image recording position is shifted. When an image is normally recorded on a recording medium P, the position of the stylus mark C is located at a constant position from the end of the recording medium P, and if the position of the stylus mark C is shifted, the positional shift of the image recording position may be found.

When the stylus mark C is formed at a side end of the recording medium P as shown in FIG. 3, a recording medium P whose image recording position shifts is to be found from a plurality of recording media P by checking the stylus mark C from sides of the plurality of recording media P on which images are formed and which are superposed.

It is desirable that the visibility of an auxiliarily drawn image is enhanced by shifting an ink jet recording head which records an image with ink having more excellent visibility than other ink jet recording heads among the ink jet recording heads 20Y and 20K. In this exemplary embodiment, the auxiliary drawing is carried out by the ink jet recording heads 20C and 20K having more excellent visibility than the ink jet recording heads 20Y and 20M.

Figure 5:
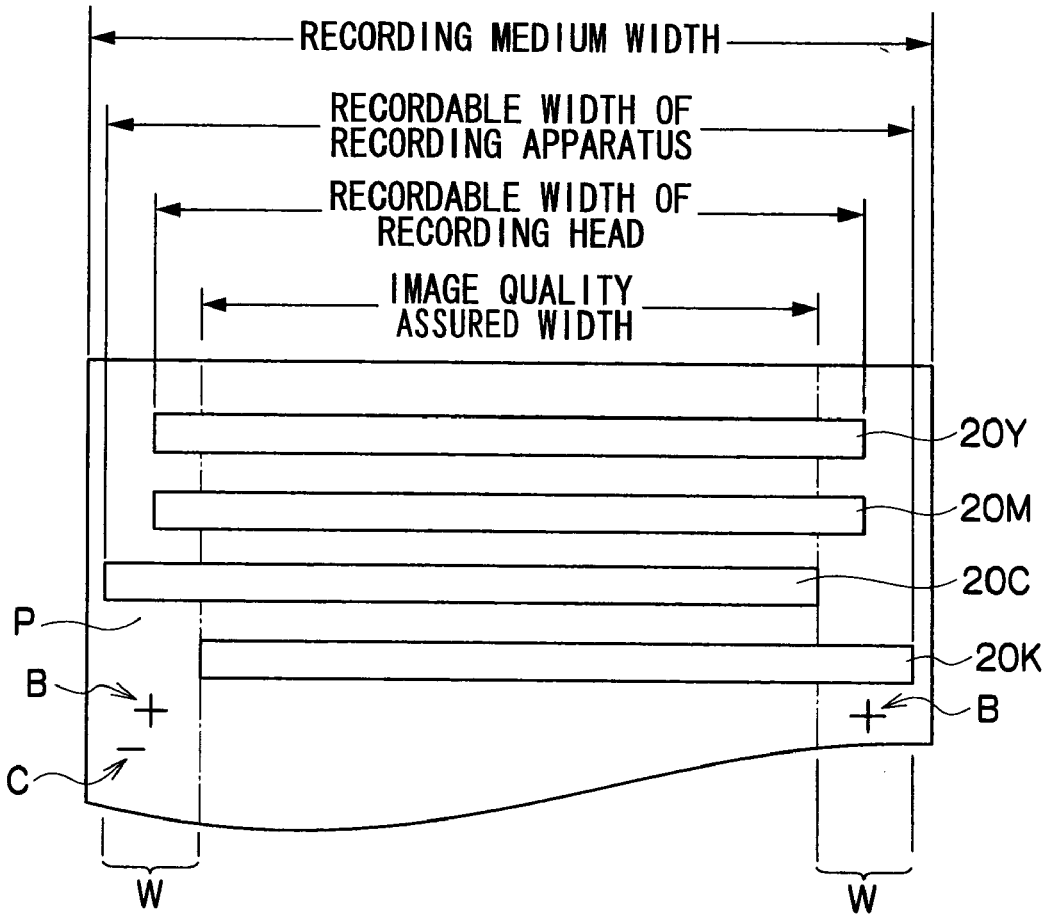
FIG. 5 is a schematic diagram showing a case where a recordable width of the ink jet recording apparatus is narrower than a width of a recording medium in the structure of the ink jet recording head of the exemplary embodiment.

When the auxiliary drawing to the side end of the recording medium P is not required, as shown in FIG. 5, the recordable width of the ink jet recording apparatus 10 may be smaller than the recording medium width of the recording medium P on which an image is to be recorded.

Figure 6:
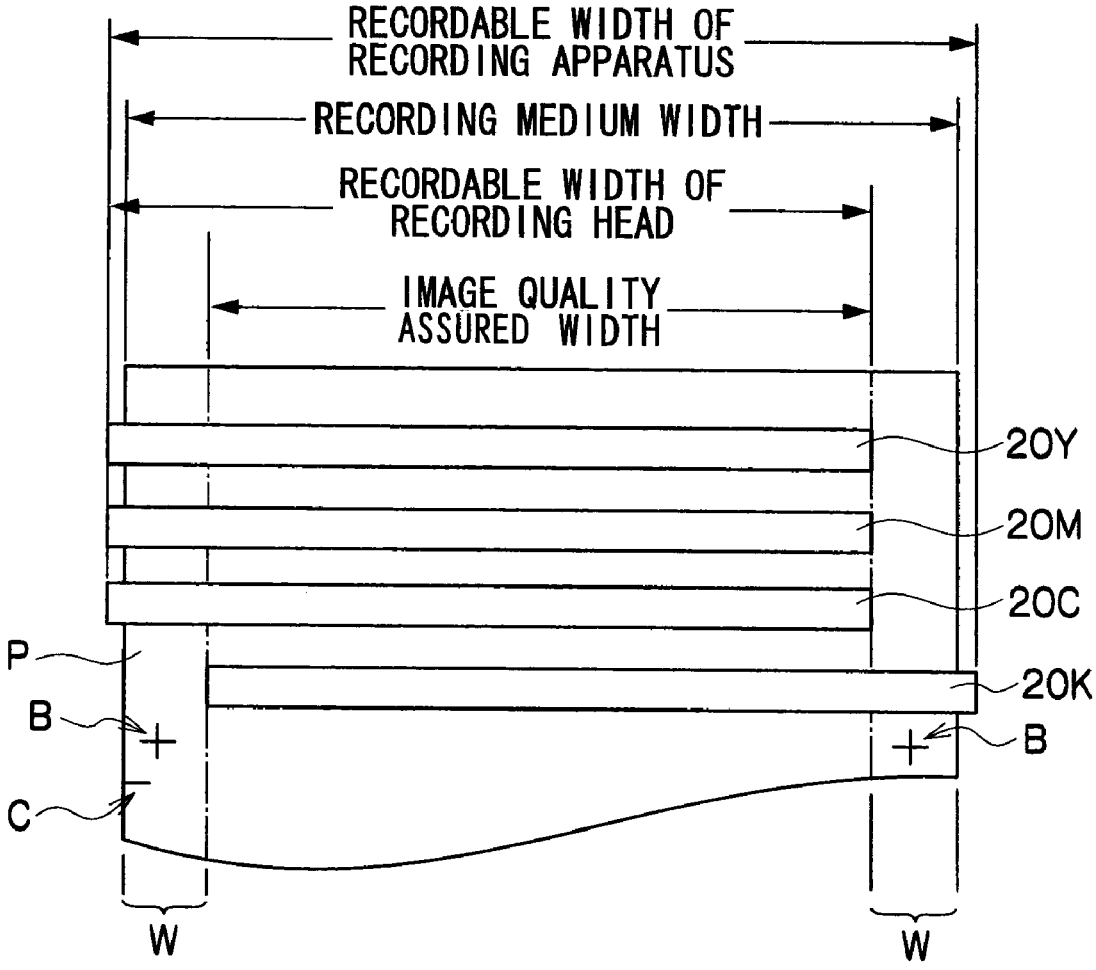
FIG. 6 is a schematic diagram showing a case where one ink jet recording head is shifted with respect to three other ink jet recording heads in the structure of the ink jet recording head of the exemplary embodiment.

As shown in FIG. 6, the ink jet recording head 20K of the ink jet recording heads 20Y to 20K may be shifted in the widthwise direction of the recordable width with respect to the ink jet recording heads 20Y to 20C. According to this structure, auxiliary drawings such as the dragonfly mark B and the stylus mark C are carried out at one end side of the recording medium P by the ink jet recording head 20K in the region W out of the image quality assured region, and auxiliary drawings such as the dragonfly mark B and the stylus mark C are carried out at the other end side of the recording medium P by the ink jet recording heads 20Y, 20M and 20C.

Figure 7:
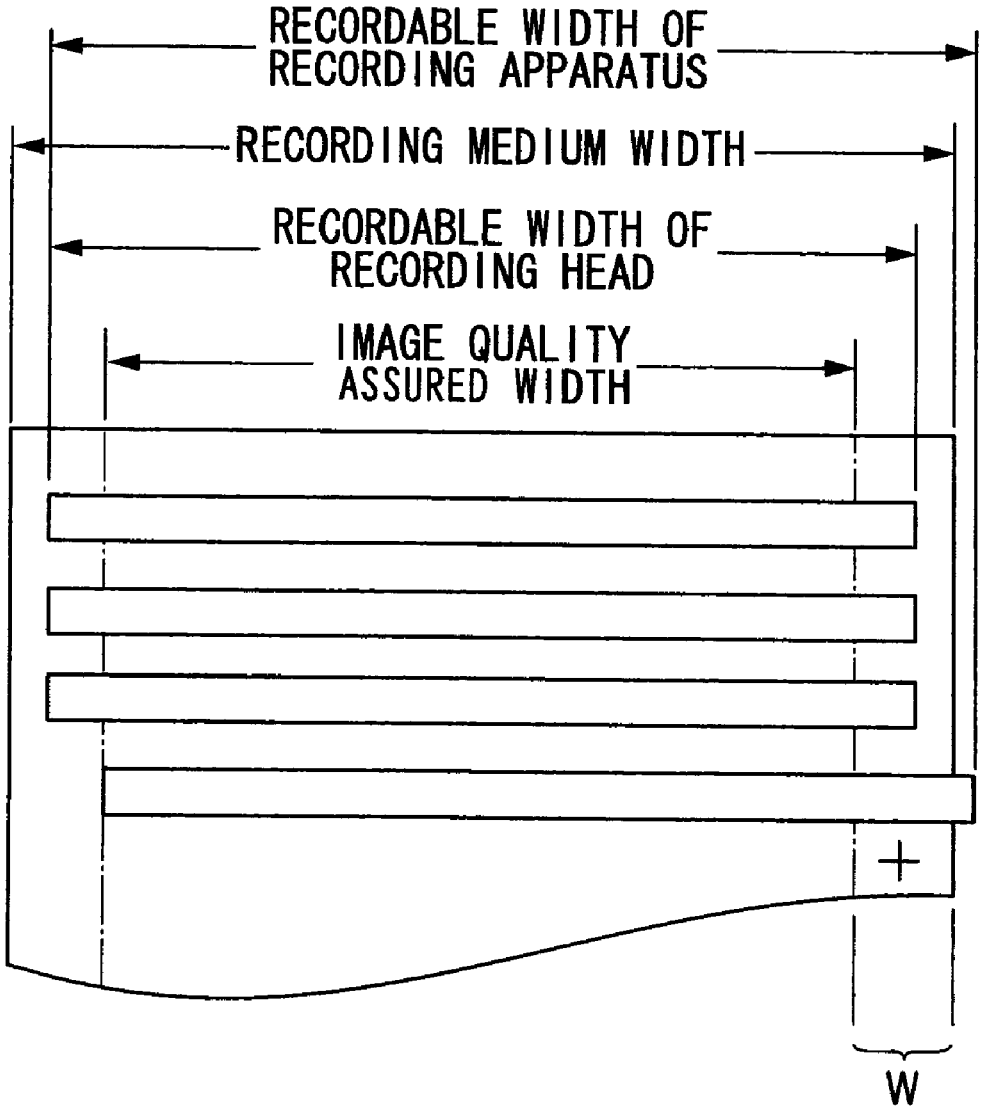
FIG. 7 is a schematic diagram showing a case where auxiliary drawing is carried out at one side of the recording medium in the structure of the ink jet recording head of the exemplary embodiment.

In a structure in which the auxiliary drawing is carried out only at one side of the recording medium P as shown in FIG. 7, the ink jet recording head 20K of the ink jet recording heads 20Y to 20K may be shifted toward one side of the recording medium P in the widthwise direction of the recordable width with respect to the ink jet recording heads 20Y to 20C.

Figure 8:
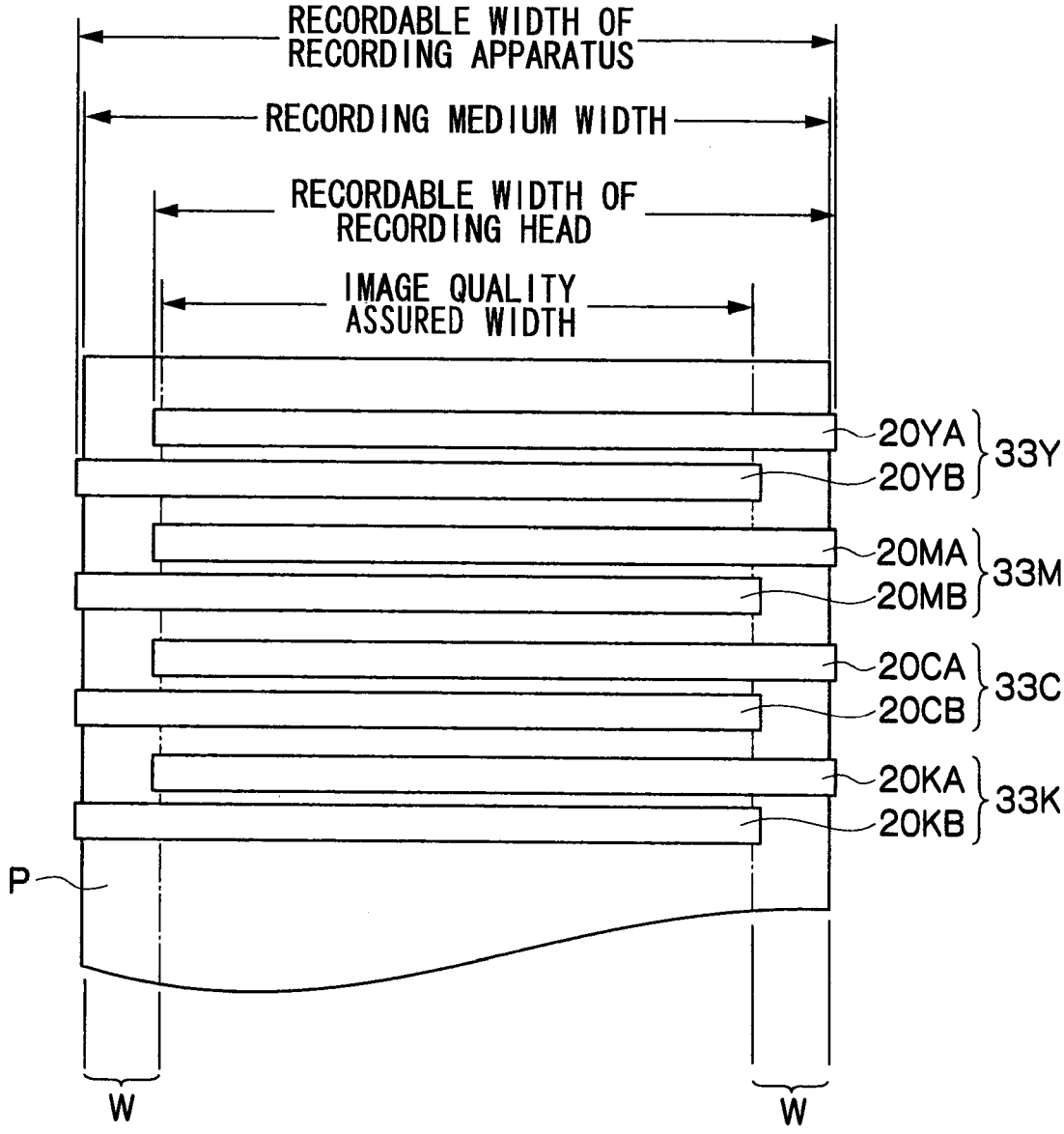
FIG. 8 is a schematic diagram showing the structure of an ink jet recording head unit of the exemplary embodiment.

As one example of a liquid droplet ejecting head unit including two liquid droplet ejecting heads which ejects the same liquid as shown in FIG. 8, an ink jet recording head unit having two ink jet recording heads ejecting ink of the same color may be used.

This structure includes ink jet recording head units 33Y, 33M, 33C and 33K (33Y to 33K, hereinafter) for respective colors, and the ink jet recording head units 33Y to 33K eject ink of different colors as one example of different liquids.

The ink jet recording head units 33Y to 33K respectively include ink jet recording heads 20YA and 20YB, ink jet recording heads 20MA and 20MB, ink jet recording heads 20CA and 20CB, and ink jet recording heads 20KA and 20KB.

Figure 9:
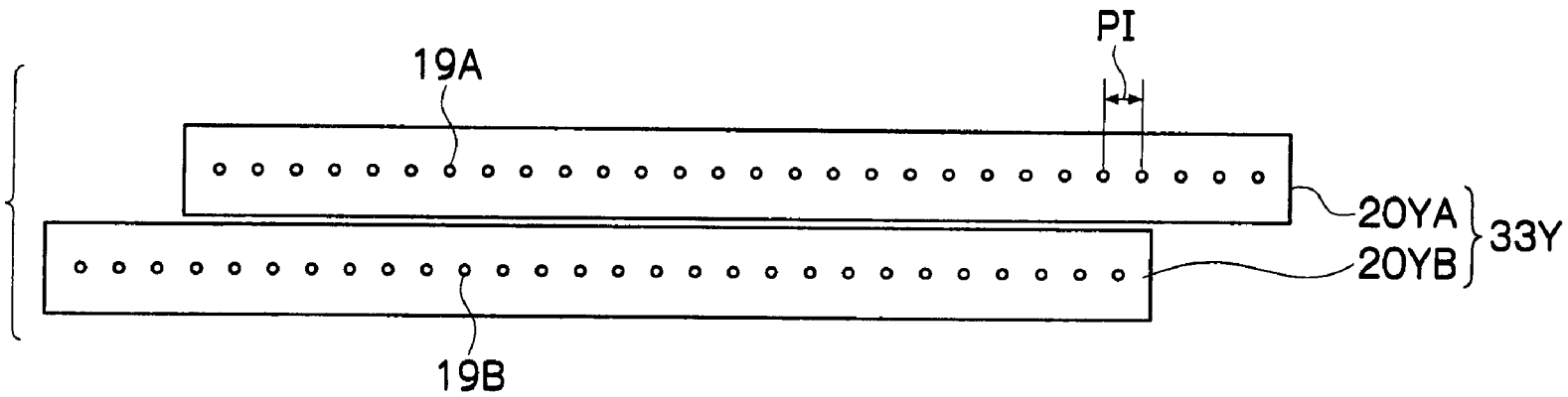
FIG. 9 is a schematic diagram showing the structure of the ink jet recording head unit of the exemplary embodiment.

As shown in FIG. 9, in the ink jet recording head unit 33Y, the ink jet recording heads 20YA and 20YB are respectively shifted to both ends of the recordable width of the ink jet recording apparatus 10 such that nozzles 19A of the ink jet recording head 20YA are shifted with respect to nozzles 19B of the ink jet recording head 20YB by half nozzle pitch (half of nozzle pitch PI). The ink jet recording head units 33M, 33C and 33K have also the same structures.

According to this structure, in the image quality assured region, a color image may be recorded with higher resolution than at the outside of the image quality assured region, and the auxiliary drawing may be carried out with color image although the resolution at the outside of the image quality assured region is lower than that in the image quality assured region. FIG. 9 schematically shows the structure of the ink jet recording head unit 33Y for explanation.

It is an object of the present invention to make it possible to carry out auxiliary drawing into a region out of an image quality assured region even when a liquid droplet ejectable width of a liquid droplet ejecting head is narrower than a liquid droplet ejectable width of a liquid droplet ejecting apparatus.

According to a first aspect of the invention, there is provided a liquid droplet ejecting apparatus, comprising: a plurality of liquid droplet ejecting heads arranged in parallel to each other, and the liquid droplet ejecting heads having the same liquid droplet ejectable width, and at least one of the liquid droplet ejecting heads being shifted in a widthwise direction of the liquid droplet ejectable width with respect to other liquid droplet ejecting heads, the liquid droplet ejecting apparatus having the following relationship: an image quality assured width<the liquid droplet ejectable width<a liquid droplet ejectable width of the apparatus using all of the plurality of liquid droplet ejecting heads.

According to a second aspect of the invention, the liquid droplet ejecting apparatus according to the first aspect further includes: a plurality of liquid droplet ejecting head units each having two of the liquid droplet ejecting heads which eject the same liquid, wherein the liquid droplet ejecting heads are respectively shifted to each end of the liquid droplet ejectable width of the apparatus such that nozzles of one of the liquid droplet ejecting heads are shifted with respect to nozzles of the other liquid droplet ejecting head by a half nozzle pitch, and the plurality of liquid droplet ejecting head units respectively eject different liquids.

According to a third aspect of the invention, in the structure of the first aspect, the plurality of liquid droplet ejecting heads eject liquid droplets to a recording medium, and the liquid droplet ejecting apparatus has the following relationship: a recording medium width of the recording medium<the liquid droplet ejectable width of the apparatus using all of the plurality of liquid droplet ejecting heads.

According to a forth aspect of the invention, in the third aspect, the liquid droplet ejectable width of respective of the liquid droplet ejecting heads is set to be narrower than the recording medium width of the recording medium.

According to the structure of the first aspect of the invention, even when the liquid droplet ejectable width of the liquid droplet ejecting head is narrower than the liquid droplet ejectable width of the liquid droplet ejecting apparatus, auxiliary drawing may be carried out in the region out of the image quality assured region.

According to the structure of the second aspect of the invention, although resolution is low as compared with the image quality assured region, auxiliary drawing may be carried out by using a plurality of kinds of liquids in the region out of the image quality assured region.

According to the structure of the third aspect of the invention, auxiliary drawing may be carried out at an end of the recording medium.

The invention is not limited to the above exemplary embodiment, and the invention may variously be modified, changed and improved. That is, the foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid droplet ejecting apparatus, comprising:

a plurality of liquid droplet ejecting heads arranged in parallel to each other, the liquid droplet ejecting heads having the same liquid droplet ejectable width, and at least one of the liquid droplet ejecting heads being shifted in a widthwise direction of the liquid droplet ejectable width with respect to other liquid droplet ejecting heads, the liquid droplet ejecting apparatus having the following relationship:

an image quality assured width<the liquid droplet ejectable width<a liquid droplet ejectable width of the apparatus using all of the plurality of liquid droplet ejecting heads, where the image quality assured width is a width of overlap of image assured regions, the image assured regions being regions that are obtained by a predetermined resolution of each of the plurality of liquid droplet ejecting heads, and a drawing unit which draws an auxiliary image beyond the image quality assured width and within the liquid droplet ejectable width of the apparatus.

2. The liquid droplet ejecting apparatus of claim 1, further comprising: a plurality of liquid droplet ejecting head units each having two of the liquid droplet ejecting heads which eject the same liquid, wherein the liquid droplet ejecting heads are respectively shifted to each end of the liquid droplet ejectable width of the apparatus such that nozzles of one of the liquid droplet ejecting heads are shifted with respect to nozzles of the other liquid droplet ejecting head by a half nozzle pitch, and the plurality of liquid droplet ejecting head units respectively eject different liquids.

3. The liquid droplet ejecting apparatus of claim 1, wherein the plurality of liquid droplet ejecting heads eject liquid droplets to a recording medium, and the liquid droplet ejecting apparatus has the following relationship:

a recording medium width of the recording medium<the liquid droplet ejectable width of the apparatus using all of the plurality of liquid droplet ejecting heads.

4. The liquid droplet ejecting apparatus of claim 3, wherein the liquid droplet ejectable width of respective of the liquid droplet ejecting heads is set to be narrower than the recording medium width of the recording medium.

5. A liquid droplet ejecting apparatus, comprising:

a plurality of liquid droplet ejecting heads arranged in parallel to each other, the liquid droplet ejecting heads having the same liquid droplet ejectable width, and at least one of the liquid droplet ejecting heads being shifted in a widthwise direction of the liquid droplet ejectable width with respect to other liquid droplet ejecting heads, the liquid droplet ejecting apparatus having the following relationship:

an image quality assured width<a liquid droplet ejectable width of the apparatus using all of the plurality of liquid droplet ejecting heads, where the image quality assured width is a width of overlap of image assured regions, the image assured regions being regions that are obtained by a predetermined resolution of each of the plurality of liquid droplet ejecting heads, and a drawing unit which draws an auxiliary image beyond the image quality assured width and within the liquid droplet ejectable width of the apparatus.

* * * * *